US010357419B2

(12) United States Patent
Zilkha et al.

(10) Patent No.: US 10,357,419 B2
(45) Date of Patent: Jul. 23, 2019

(54) ROCKER FOR RELEASING LEG MUSCLE CRAMPS

(71) Applicant: Vibex Pro Ltd., Holon (IL)

(72) Inventors: Gal Zilkha, Harish Kazir (IL); Eliran Igal, Kiryat Ono (IL)

(73) Assignee: VIBEX PRO Ltd., Holon (IL)

( * ) Notice: Subject to any disclaimer, the term of this patent is extended or adjusted under 35 U.S.C. 154(b) by 1070 days.

(21) Appl. No.: 14/435,986

(22) PCT Filed: Oct. 8, 2013

(86) PCT No.: PCT/IL2013/050816
§ 371 (c)(1),
(2) Date: Apr. 15, 2015

(87) PCT Pub. No.: WO2014/064677
PCT Pub. Date: May 1, 2014

(65) Prior Publication Data

US 2015/0290070 A1 Oct. 15, 2015

(30) Foreign Application Priority Data

Oct. 24, 2012 (IL) ..... 222663

(51) Int. Cl.
*A61H 1/02* (2006.01)
*A61H 23/02* (2006.01)

(52) U.S. Cl.
CPC ..... *A61H 1/0237* (2013.01); *A61H 1/02* (2013.01); *A61H 1/0255* (2013.01);
(Continued)

(58) Field of Classification Search
CPC ..... A61H 1/00; A61H 1/02; A61H 1/0214; A61H 1/0237; A61H 1/0255;
(Continued)

(56) References Cited

U.S. PATENT DOCUMENTS 4,862,875 A * 9/1989 Heaton ..... A61H 1/0266 601/26
4,949,712 A * 8/1990 Torii ..... A61H 1/008 601/27

(Continued)

FOREIGN PATENT DOCUMENTS

| | | |
|---|---|---|
| CN | 2101486 U | 4/1992 |
| EP | 0285438 A2 | 10/1988 |
| JP | 2001321410 A | 11/2001 |

OTHER PUBLICATIONS

International Search Report dated Feb. 2, 2014 in corresponding application PCT/IL2013/050816.

*Primary Examiner* — Colin W Stuart
(74) *Attorney, Agent, or Firm* — Muncy, Geissler, Olds & Lowe, P.C.

(57) ABSTRACT

A rocker for releasing leg muscle cramps is described in the present application. The rocker is a device that mechanically rocks the legs of a user for their release from muscle cramps. While releasing the leg muscle cramps, the user is lies on his back; his legs are attached to the rocker, which is capable of rocking the legs in various rocking movement patterns. These movements can include movement components in any possible direction, combined with movement components such as horizontal vibration, which is practically parallel to the direction in which the user is lying, a horizontal vibration component which is perpendicular to the direction of the previous movement component, and a vertical movement component. The user can choose the frequency of vibration of these movement components, and the result is vibration with a complex spatial movement.

18 Claims, 5 Drawing Sheets

(52) U.S. Cl.
CPC ..... *A61H 1/0266* (2013.01); *A61H 23/0254* (2013.01); *A61H 2001/0248* (2013.01); *A61H 2001/0251* (2013.01); *A61H 2201/1436* (2013.01); *A61H 2201/164* (2013.01); *A61H 2201/1642* (2013.01); *A61H 2201/1666* (2013.01); *A61H 2201/5005* (2013.01); *A61H 2201/5097* (2013.01); *A61H 2203/0456* (2013.01); *A61H 2205/10* (2013.01)

(58) Field of Classification Search
CPC ..... A61H 1/0266; A61H 2001/0203; A61H 2001/0248; A61H 2001/0251; A61H 2201/164; A61H 2205/10
USPC ..... 601/27, 29, 33, 34, 35, 97
See application file for complete search history.

(56) References Cited

U.S. PATENT DOCUMENTS

| | | | | | |
|---|---|---|---|---|---|
| 5,411,469 | A * | 5/1995 | Wang | A61H 1/0237 | 601/90 |
| 5,417,644 | A * | 5/1995 | Lee | A61H 1/0237 | 601/101 |
| 5,468,215 | A * | 11/1995 | Park | A61H 1/0237 | 601/23 |
| 6,056,706 | A * | 5/2000 | Hung | A61H 1/0237 | 601/101 |
| 6,342,042 | B1 * | 1/2002 | Martin | A61H 1/0237 | 601/84 |
| 6,511,447 | B1 * | 1/2003 | Huang | A61H 1/0237 | 482/79 |
| 2004/0102724 | A1 * | 5/2004 | Hirt | A61H 1/0237 | 601/35 |

* cited by examiner

ROCKER FOR RELEASING LEG MUSCLE CRAMPS

CROSS-REFERENCE TO RELATED PATENT APPLICATIONS

This application is a U.S. National Stage Application under 35 U.S.C. § 371 of International Patent Application No. PCT/IL2013/050816, filed Oct. 8, 2013, and claims priority to IL222663, filed Oct. 24, 2012, all of which are incorporated by reference in their entireties. The International Application was published on May 1, 2014 as International Publication No. WO2014/064677 A1.

FIELD OF THE INVENTION

The present invention relates to a device for releasing muscle cramps, more particularly, to a device for releasing legs muscle cramps, by rocking them.

BACKGROUND OF THE INVENTION

Muscle cramps in the human body in general, and specifically in the legs is a common phenomenon, which can be even extremely troubling to those who suffer from it. The suffering can cause pain and decrease the quality of living.

There are various different reasons for the formation of muscle cramps, such as in response to physical effort, for example from sports. There are many medical reasons for muscle cramps as well.

Muscle cramps may go away after several days, however, there is a need to shorten the duration of the cramps, in many cases, immediately.

The most commonly known solutions for this include massaging the cramped muscle, often by rocking or manipulating it.

A typical example of this is during soccer tournaments, when the games run into overtime, are not settled even after 120 minutes of play, and come to the point of being determined by penalty kicks. In the brief interval prior to starting the kicks, many players can be seen lying down on the turf, with their teammates holding their ankles and rocking them in order to relieve the leg muscles that are cramped from the excessive effort of the long game.

There is therefore a need for a device that will enable effective release of muscle cramps.

BRIEF SUMMARY EMBODIMENTS OF THE INVENTION

The background art does not teach or suggest a device for effective release of muscle cramps.

The present invention is of a device that mechanically rocks the legs of a user for their release from muscle cramps.

As used herein this application, in the specifications, the illustrations, and the claims section that follows, the term 'pivotally connected' and the like refer to a connection of one element to one or more other elements, such as arms, such that the connection enables both elements to have angular movement with regard to each other, while they are connected to each other. The connection can be any suitable type of mechanical connection, such as by means of a shaft, and can include one or more bearing. This kind of connection also enables the transfer of forces between connected elements.

Additional objects and advantages of the invention will be set forth in part in the description which follows and, in part, will be obvious from the description, or may be learned by practice of the invention.

BRIEF DESCRIPTION OF THE DRAWINGS

The invention is herein described, by way of example only, with reference to the accompanying drawings, wherein.

Figure 1:
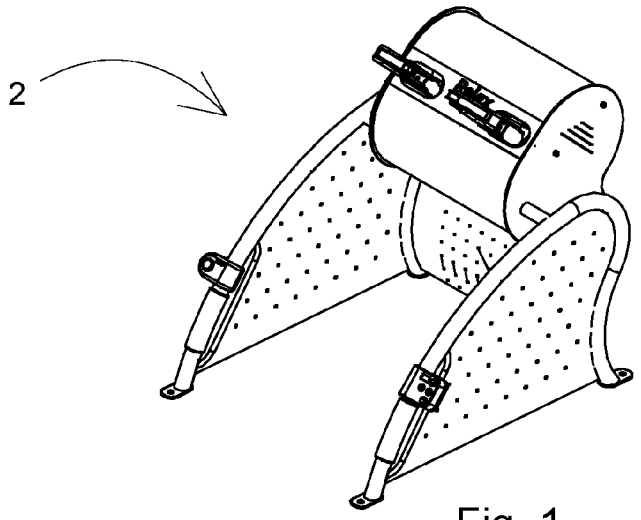
FIG. 1 is an isometric view, schematic illustration of an exemplary embodiment of a rocker, according to the present invention.

In order to leave no room for doubt, the elements shown in the illustrations of the present patent application in a manner that enables understanding them clearly, and the scales, size relations, and shapes are not in any way limiting their embodiment.

DETAILED DESCRIPTION OF EMBODIMENTS OF THE INVENTION

To remove any doubt, note that the manner in which the elements of the present invention are described in the illustrations can be highly detailed, however is not in any way limiting the present invention, however is for the purpose of clarification and furthering understanding. The present invention can be implemented in embodiments that differ from the specification given with regard to the illustration.

The present invention is of a device that mechanically rocks the legs of a user for the purpose of release from muscle cramps.

The principles and operation of the device that mechanically rocks the legs of a user for the purpose of release from muscle cramps according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The following list is a legend of the numbering of the application illustrations:

1 user
2 rocker
11 back
12 leg
13 ankle
100 rocking assembly
100' longitudinal rocking sub-assembly
100" lateral rocking sub-assembly
101*a* aft clamp part
101*b* frontal clamp part
101*c* holder support member
101*d* piston
101*l* left leg holder
101*r* right leg holder
110 lateral rocking engine
112 second eccentric arm
113 lateral rocking sub-assembly first arm
114 lateral rocking sub-assembly second arm
115 lateral rocking sub-assembly third arm
115*c* lateral rocking sub-assembly third arm rotational center
115*u* lateral rocking sub-assembly third arm upper end
115*l* lateral rocking sub-assembly third arm lower end
120 longitudinal rocking engine
121 shaft
121' shaft first end
121" shaft second end
122 first eccentric arm
123 longitudinal rocking sub-assembly first pivot
124 longitudinal rocking sub-assembly arm
125 longitudinal rocking sub-assembly second pivot
126 rider element
127 second axis
128 track
129 first axis
130 rocking assembly base
152 electrical wire
153 frequency controller
154 electrical connection box
200 chassis assembly
201 chassis base
202 chassis frame
203 chassis back wall
204 chassis side wall
205 chassis lateral pole
206 chassis housing
207 chassis housing side wall
301 longitudinal movement
302 rider element movement
303 rotational movement
401 lateral movement
402 rotational movement Hereinafter, embodiments of the present invention are explained in detail by referring to the drawings.

FIG. 1 is an isometric view, schematic illustration of an exemplary embodiment of a rocker 2, according to the present invention.

Figure 2B:
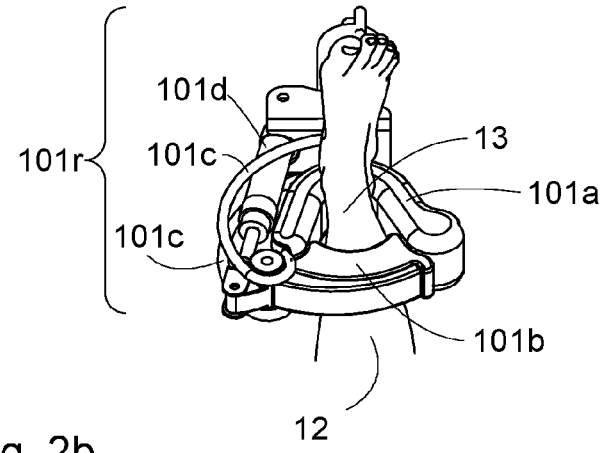
FIG. 2*b* is an isometric view, schematic illustration of an exemplary embodiment of a user's leg connected to a right leg holder, according to the present invention.
Figure 2A:
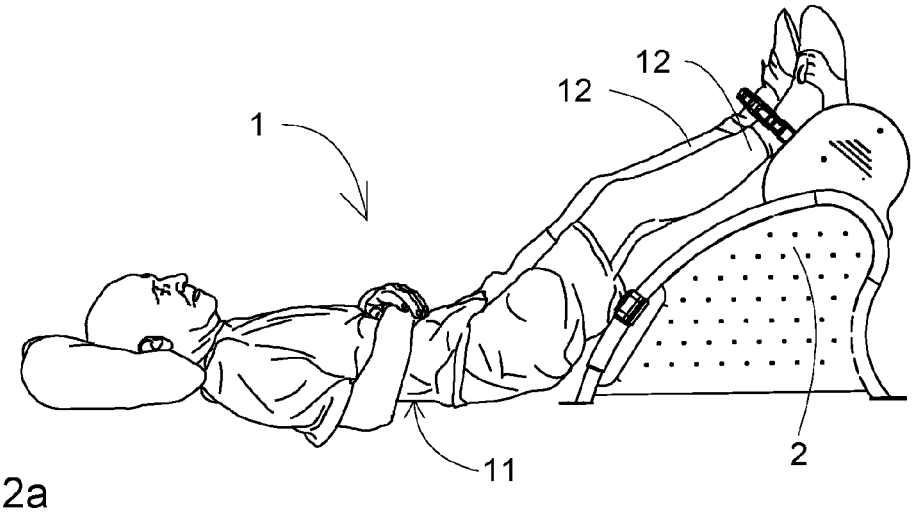
FIG. 2*a* is a side view, schematic illustration of an exemplary embodiment of a user and of a rocker, according to the present invention.

FIG. 2*a* is a side view, schematic illustration of an exemplary embodiment of a user 1 and of rocker 2, according to the present invention.

User 1 lies on his back 11, his legs 12 are connected the rocker 2. Rocker 2 is capable of rocking the legs 12 of the user 1 in various rocking movement patterns, which are not limited by the present invention. These movements can include movement components in any possible directions, combined with movement components such as horizontal vibration, which is practically parallel to the direction in which the user 1 is lying, a horizontal vibration component which is perpendicular to the direction of the previous movement component, and a vertical movement component.

According to the present invention, user 1 can choose the frequency of vibration of these movement components, and the result is vibration with a complex spatial movement.

Lying on the back has been found to be most effective for this, seeing as in this case the leg muscles are in almost no effort whatsoever.

FIG. 2*b* is an isometric view, schematic illustration of an exemplary embodiment of a user's leg 12 connected to a right leg holder 101*r*, according to the present invention.

The leg 12, a right leg in the case shown in the present illustration, is connected to the right leg holder 101*r* near the ankle 13, which is gripped by a gripping means, which is in the present case a clamp, which is composed of two components, an aft clamp part 101*a* and a frontal clamp part 101*b*, carried by two holder support members 101*c*, whose shape can also be close to an arched shape, and they can be composed of one or more elastic materials.

The frontal clamp part 101*b* can be opened and closed relative to aft clamp part 101*a* so that leg 12 can be inserted between them and released as necessary.

Piston 101*d* applies closing force on the frontal clamp part 101*b*.

Figure 3A:
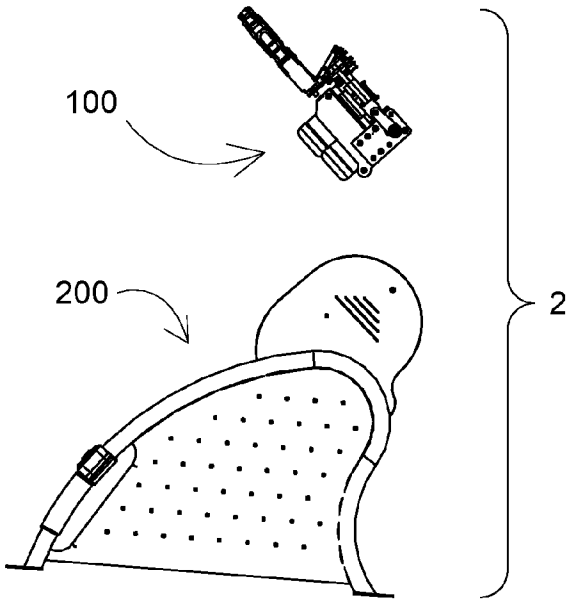
FIG. 3*a* is an exploded side view schematic illustration of the exemplary embodiment of the rocker, according to the present invention.

FIG. 3*a* is an exploded side view schematic illustration of an exemplary embodiment of the rocker 2, according to the present invention.

The rocker 2, shown here, includes two main assemblies, a rocking assembly 100 and a chassis assembly 200, which are mechanically interconnected.

Figure 3B:
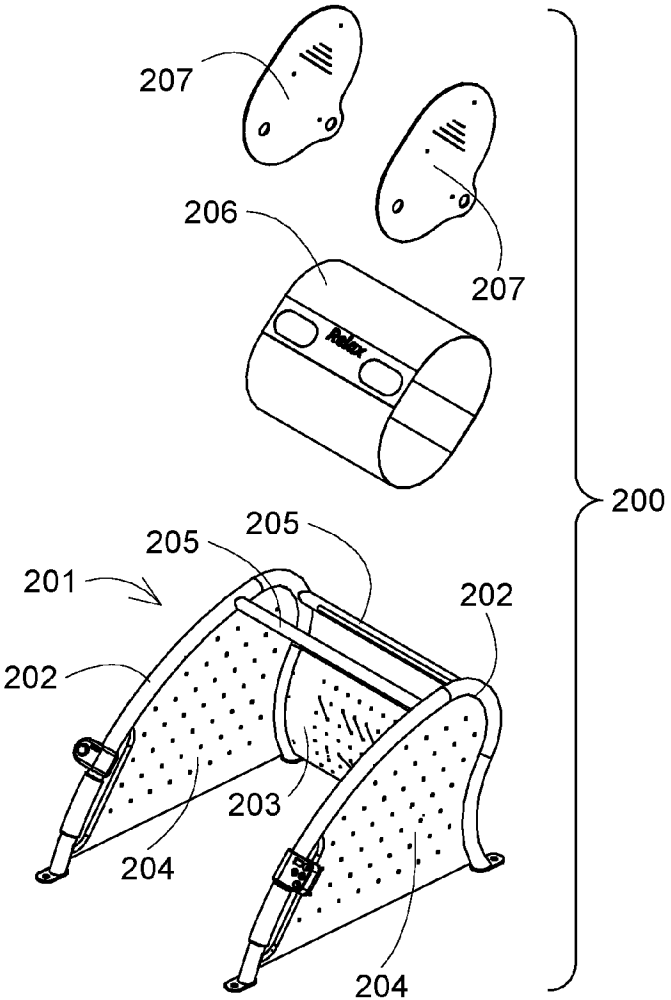
FIG. 3*b* is an exploded isometric view schematic illustration of the exemplary embodiment of the chassis assembly, according to the present invention.

FIG. 3*b* is an exploded isometric view schematic illustration of the exemplary embodiment of the chassis assembly 200, according to the present invention.

The chassis assembly 200, as noted, carries the rocking assembly 100 (not shown in the present illustration, shown in FIG. 2*a*), and connecting the rocking assembly 100 to the ground, or to the floor, wall, or ceiling or any other support.

The chassis assembly 200 according to the exemplary embodiment of the present illustration includes a chassis base 201 including two chassis frames 202, to each of which is connected a chassis side wall 204, and in between them is connected a chassis back wall 203.

Both chassis frames 202 are connected to each other by means of chassis lateral poles 205.

Furthermore, the chassis assembly 200 includes a chassis housing 206, which can be cylindrical and be closed by two chassis housing side walls 207.

The chassis housing 206 is designated to carry at least some of the rocking assembly 100 (not shown in the present illustration, shown in FIG. 2*a*).

These elements can be separate, interconnected components, or some of them can be made as a single, integrated component.

Figure 4A:
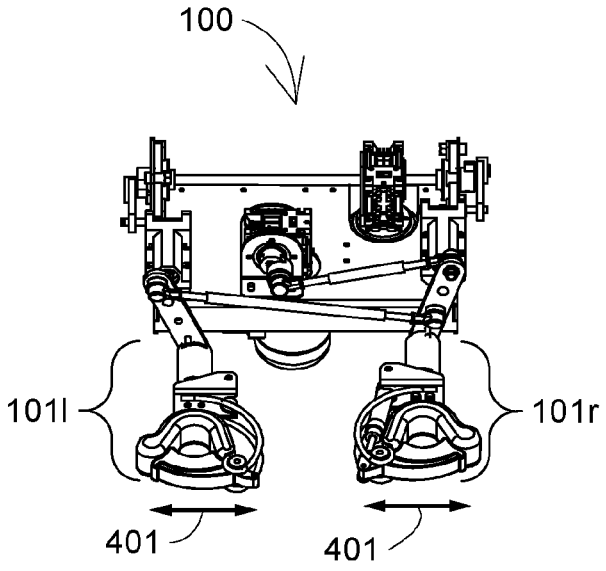
FIG. 4*a* is a top view, schematic illustration of an exemplary embodiment of a rocking assembly, according to the present invention.

FIG. 4*a* is a top view, schematic illustration of an exemplary embodiment of a rocking assembly 100, according to the present invention.

The rocking assembly 100 also includes a right leg holder 101*r* and a left leg holder 101*l*, or at least one leg holder. One of the movement components that the right leg holder 101*r* and the left leg holder 101*l* can perform is lateral movement 401. This movement is, when the user 1 (not shown in the present illustration, shown in FIG. 2*a*) is lying on his back, practically horizontal movement and can result in sideways spreading of the legs 12 (not shown in the present illustration, shown in FIG. 2*a*).

Figure 4B:
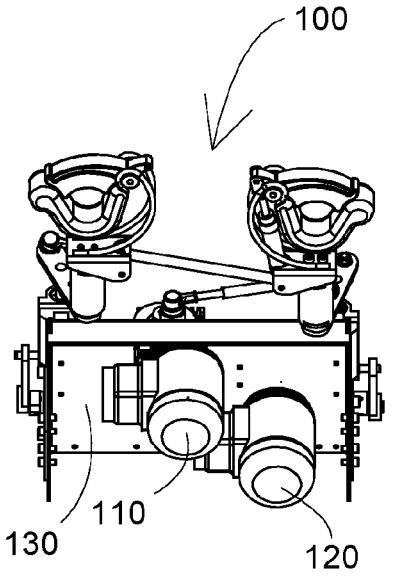
FIG. 4*b* is a front view, schematic illustration of an exemplary embodiment of a rocking assembly, according to the present invention.

FIG. 4*b* is a front view, schematic illustration of an exemplary embodiment of a rocking assembly 100, according to the present invention.

The present illustration also shows a lateral rocking engine 110 and a longitudinal rocking engine 120 which are connected to a rocking assembly base 130.

Figure 4C:
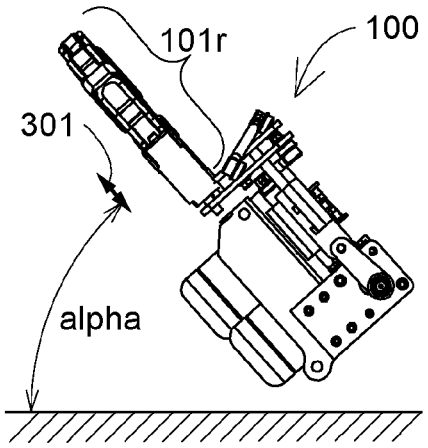
FIG. 4*c* is a right view, schematic illustration of an exemplary embodiment of a rocking assembly, according to the present invention.

FIG. 4*c* is a right view, schematic illustration of an exemplary embodiment of a rocking assembly 100, according to the present invention.

The right leg holder 101*r* is slanted at angle alpha to the horizon, and the present illustration demonstrates an additional possible movement component, a longitudinal movement 301, which occurs practically at this angle and at least approximately perpendicular to the component of the lateral movement 401 (not shown in the present illustration, shown in FIG. 4*a*).

Figure 4D:
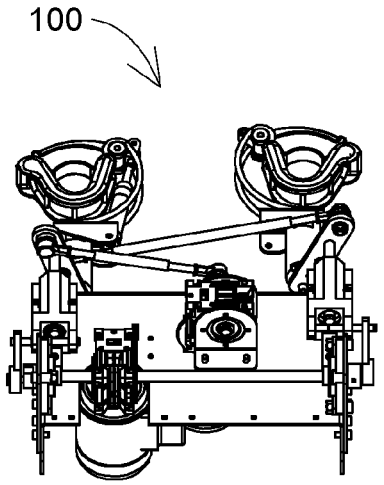
FIG. 4*d* is a back view, schematic illustration of an exemplary embodiment of a rocking assembly, according to the present invention.

FIG. 4*d* is a back view, schematic illustration of an exemplary embodiment of a rocking assembly 100, according to the present invention.

Figure 5A:
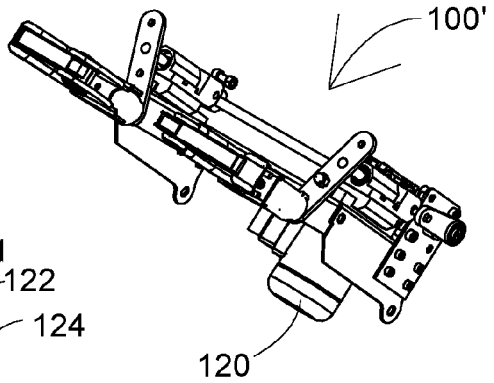
FIG. 5*a* is a right isometric view, schematic illustration of an exemplary embodiment of a longitudinal rocking sub-assembly, according to the present invention.

FIG. 5*a* is a right isometric view, schematic illustration of an exemplary embodiment of a longitudinal rocking sub-assembly 100', according to the present invention.

The longitudinal rocking engine 120 composes a part of the longitudinal rocking sub-assembly 100'.

Figure 5B:
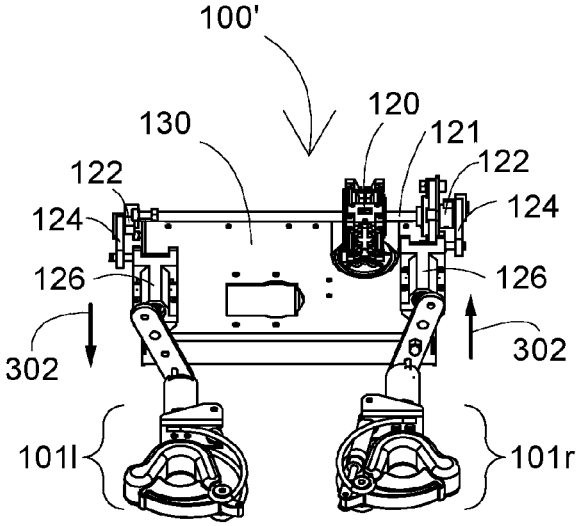
FIG. 5*b* is a top view, schematic illustration of an exemplary embodiment of a longitudinal rocking sub-assembly, according to the present invention.

FIG. 5*b* is a top view, schematic illustration of an exemplary embodiment of a longitudinal rocking sub-assembly 100', according to the present invention.

The longitudinal rocking engine 120, which is mechanically connected to the rocking assembly base 130, transmits rotational movement to a shaft 121 to which two first eccentric arms 122 are rigidly connected at a phase difference of 180 degrees, with regard to its rotational movement.

Each of both first eccentric arms 122 is pivotally connected to a longitudinal rocking sub-assembly arm 124, which is pivotally connected to a rider element 126.

This method of connection grants each of both rider elements 126 a rider element movement 302 in opposite directions, thanks to the phase difference of 180 degrees. If the phase difference is other than 180 degrees, the relative movement directions will differ.

The rider element movement 302 is mechanically transmitted to the left leg holder 101*l* and the right leg holder 101*r*.

Figure 5D:
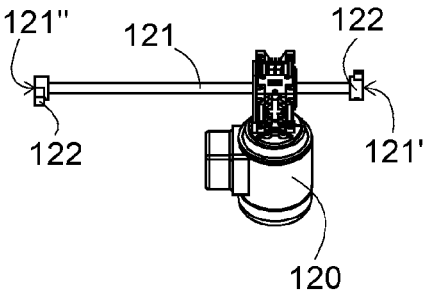
FIG. 5*d* is a top view, schematic illustration of an exemplary embodiment of a few elements of the longitudinal rocking engine, the shaft and two first eccentric arms, according to the present invention.
Figure 5C:
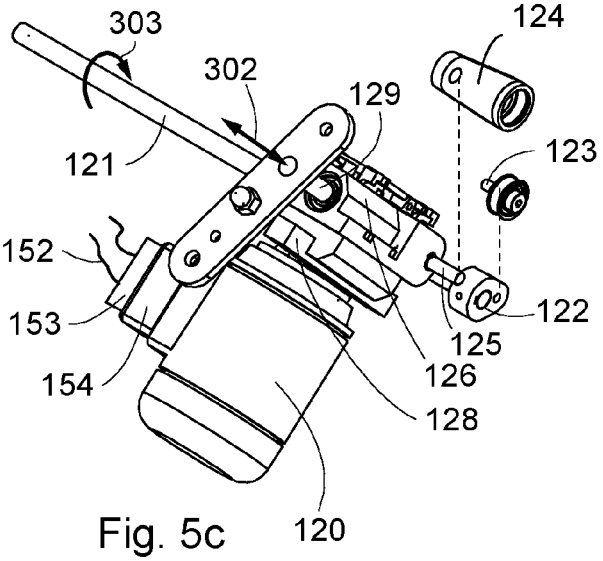
FIG. 5*c* is a right isometric view, schematic illustration of an exemplary embodiment of a few elements of the longitudinal rocking sub-assembly, according to the present invention.

FIG. 5*c* is a right isometric view, schematic illustration of an exemplary embodiment of a few elements of the longitudinal rocking sub-assembly, according to the present invention.

The illustration shows several elements in more detail than in the previous illustration.

The longitudinal rocking engine 120, which in the case shown in the present illustration is an electric engine, electrically fed from an electrical connection box 154, which is electrically fed from a frequency controller 153 connected by means of electrical wires 152 to an electrical power supply, not shown in the present illustration. Namely, the longitudinal rocking engine 120 is electrically connected to the frequency controller 153.

The longitudinal rocking engine 120 is mechanically connected to the shaft 121 for transferring a rotational movement 303.

User 1 (not shown in the present illustration, shown in FIG. 2*a*) can remotely control the frequency controller 153 and thus affect some of the vibration frequencies he feels.

The longitudinal rocking engine 120 grants a rotational movement 303 to the shaft 121.

The present illustration shows the longitudinal rocking sub-assembly first pivot 123 and the longitudinal rocking sub-assembly second pivot 125, demonstrating possibilities to achieve the pivotal connections noted with regard to the previous illustration.

Furthermore, the present illustration shows track 128, on which one of the rider elements 126 is riding.

FIG. 5*d* is a top view, schematic illustration of an exemplary embodiment of a few elements of the longitudinal rocking engine 120 the shaft 121 and two first eccentric arms 122, according to the present invention.

The shaft 121 has two ends, a shaft first end 121' and a shaft second end 121" each of which is connected to one first eccentric arm 122.

The two first eccentric arms 122 are connected to the shaft 121 at a predetermined phase angle, which in the case shown in the present illustration is 180 degrees, namely during the rotation of shaft 121, when one first eccentric arm 122 is pointing upward, the other first eccentric arm 122 points downward.

Figure 6A:
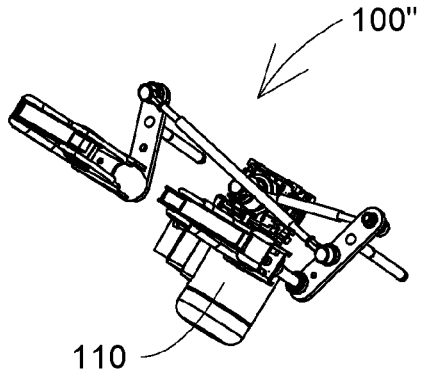
FIG. 6*a* is a right isometric view, schematic illustration of an exemplary embodiment of a lateral rocking sub-assembly, according to the present invention.

FIG. 6*a* is a right isometric view, schematic illustration of an exemplary embodiment of a lateral rocking sub-assembly 100", according to the present invention.

The lateral rocking engine 110 composes a part of the lateral rocking sub-assembly 100".

Figure 6B:
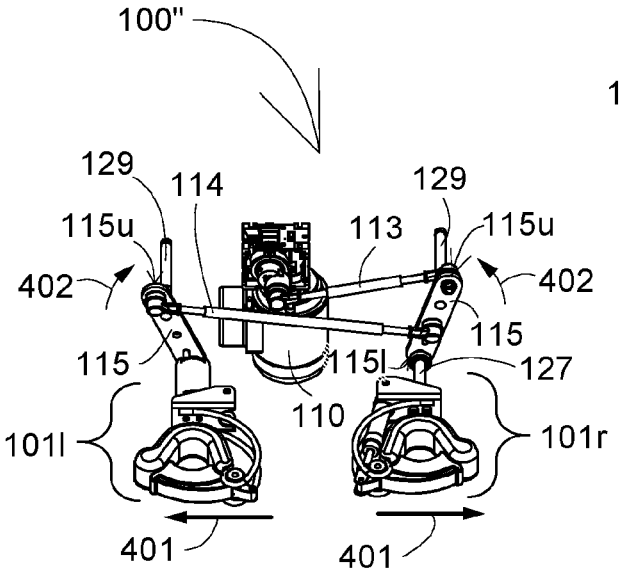
FIG. 6*b* is a top view, schematic illustration of an exemplary embodiment of a lateral rocking sub-assembly, according to the present invention.

FIG. 6*b* is a top view, schematic illustration of an exemplary embodiment of a lateral rocking sub-assembly 100", according to the present invention.

The lateral rocking engine 110 transmits combined linear and angular movements to a lateral rocking sub-assembly first arm 113. The lateral rocking sub-assembly first arm 113 is pivotally connected to a lateral rocking sub-assembly third arm 115 near its upper end 115*u*. The lateral rocking sub-assembly third arm 115 is connected to a first axis 129 which is pivotally connected to a rider element 126 (not shown in the present illustration, shown in FIG. 5*c*). A lateral rocking sub-assembly second arm 114 is pivotally connected to the lateral rocking sub-assembly third arm 115 wherein the connection point of the first axis 129 is between the connections points of the lateral rocking sub-assembly first arm 113 and the lateral rocking sub-assembly second arm 114 to the lateral rocking sub-assembly third arm 115. The lateral rocking sub-assembly second arm 114 is also pivotally connected, at its other end to a second lateral rocking sub-assembly third arm 115, this time near its upper end 115*u*.

This method of connection grants both lateral rocking sub-assembly third arms 115 rotational movement 402 in opposite directions which cause lateral movement 401 in opposite directions of the left leg holder 101*l* and the right leg holder 101*r*.

Figure 6C:
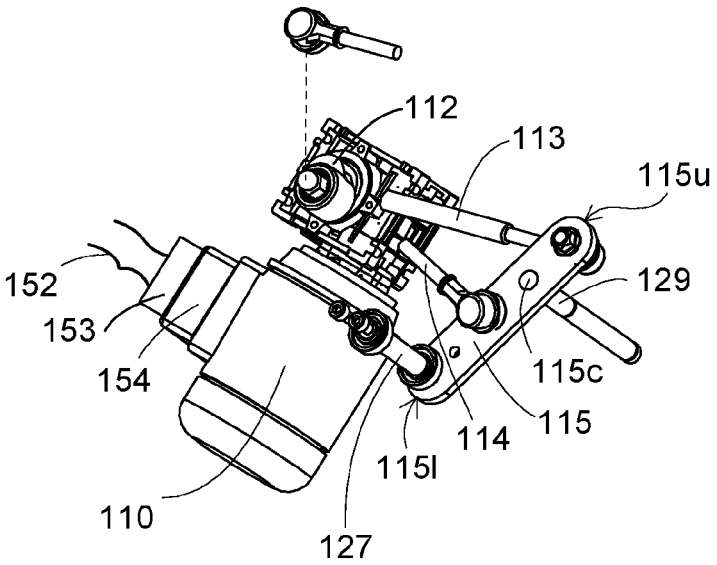
FIG. 6*c* is a right isometric view, schematic illustration of an exemplary embodiment of a few elements of the lateral rocking sub-assembly, according to the present invention.

FIG. 6*c* is a right isometric view, schematic illustration of an exemplary embodiment of few elements of the lateral rocking sub-assembly, according to the present invention. The present illustration shows several elements in greater detail than in the previous illustration.

The lateral rocking engine 110 transmits rotational movement to a second eccentrics arm 112, wherein the second eccentrics arm 112 is pivotally connected to the lateral rocking sub-assembly first arm 113, which as a result, is granted rotational movement. The connection point of a first axis 129 to a second lateral rocking sub-assembly third arm 115 composes a lateral rocking sub-assembly third arm rotational center 115*c*.

A second axis 127 enables a pivotally connection between a second lateral rocking sub-assembly third arm 115 and a leg holder, such as the left leg holder 101*l*, and/or the right leg holder 101*r*.

The lateral rocking engine 110, which is in the case described in the present illustration an electrical engine, electrically fed from an electrical connection box 154, which is electrically fed from a frequency controller 153 connected by means of electrical wires 152 to an electrical power source, not shown in the present illustration, namely the lateral rocking engine 110 is electrically connected to the frequency controller 153.

User 1 (not shown in the present illustration, shown in FIG. 2*a*) can remotely control both frequency controllers 153, and thus affect the rocking frequencies he will feel.

The detailed specification of the invention as is described in the illustrations shows that the rocker 2 is configured to enable a user 1 to lie on his back 11, connect his legs 12 to the rocker 2, and activate it such that the rocker 2 rocks his legs 12 thus enabling full or partial release of leg muscle cramps.

The rocker 2 is also configured to enable a user 1 to control the frequencies of the rocking movement components.

According to the present invention user 1 can also connect only one leg 12 and rock it instead of rocking both legs at the same time.

According to another embodiment of the present invention the rocker 2 is configured to rock only one leg 12 at a time.

While the invention has been described with respect to a limited number of embodiments, it will be appreciated that many variations, modifications and other applications of the invention may be made.

What is claimed is:

1. A rocker, comprising:

a rocking assembly comprising:

a first leg holder, wherein said first leg holder is configured to hold a leg of a user;

a second leg holder, wherein said second leg holder is configured to hold a leg of a user, wherein said second leg holder is mechanically connected to said first leg holder, a longitudinal rocking sub-assembly comprising:

a longitudinal rocking engine;

a shaft mechanically connected to said longitudinal rocking engine, for receiving a rotational movement;

a first first eccentric arm disposed on a first end of said shaft; and a second first eccentric arm disposed on a second end of said shaft, wherein said first first eccentric arm and said second first eccentric arm has a predetermined phase angle between both of them, and wherein said longitudinal rocking sub-assembly further comprise:

a first longitudinal rocking sub-assembly arm pivotally connected to said first first eccentric arm;

a first rider element pivotally connected to said first longitudinal rocking sub-assembly arm;

a first first axis pivotally connected to said first rider element;

a second longitudinal rocking sub-assembly arm pivotally connected to said second first eccentric arm;

a second rider element pivotally connected to said second longitudinal rocking sub-assembly arm; and a second first axis pivotally connected to said second rider element, wherein the first first axis is linearly movable along an axial direction of the first first axis and the second first axis is linearly movable along an axial direction of the second first axis.

2. The rocker of claim 1 further comprising:

a chassis assembly mechanically connected to said rocking assembly.

3. A rocker, comprising:

a rocking assembly comprising:

a first leg holder, wherein said first leg holder is configured to hold a leg of a user;

a second leg holder, wherein said second leg holder is configured to hold a leg of a user, wherein said second leg holder is mechanically connected to said first leg holder, a lateral rocking sub-assembly comprising:

a lateral rocking engine;

a second eccentric arm mechanically connected to said lateral rocking engine, for receiving a rotational movement;

a lateral rocking sub-assembly first arm pivotally connected to said second eccentric arm;

a first lateral rocking sub-assembly third arm pivotally connected at an upper end of said first lateral rocking sub-assembly third arm to said lateral rocking sub-assembly first arm;

a first first axis connected to said first lateral rocking sub-assembly third arm at a first lateral rocking sub-assembly third arm rotational center; and a lateral rocking sub-assembly second arm pivotally connected to said first lateral rocking sub-assembly third arm at a point that is located in a direction from said rotational center opposite to a direction from said rotational center to said upper end of said first lateral rocking sub-assembly third arm.

4. The rocker of claim 3 wherein said lateral rocking sub-assembly further comprising:

a second lateral rocking sub-assembly third arm pivotally connected to said lateral rocking sub-assembly second arm, at an upper end of said second lateral rocking sub-assembly third arm; and a second first axis connected to said second lateral rocking sub-assembly third arm at a rotational center of said second lateral rocking sub-assembly third arm.

5. The rocker of claim 4 wherein said first leg holder is connected to a first second axis, wherein said first second axis is pivotally connected to said first lateral rocking sub-assembly third arm at a lower end of said first lateral rocking sub-assembly third arm, and wherein said second leg holder is connected to a second second axis, wherein said second second axis is pivotally connected to said second lateral rocking sub-assembly third arm at a lower end of said second lateral rocking sub-assembly third arm.

6. The rocker of claim 5 configured to enable a user to connect said user's legs to said rocker while lying on said user's back and rocking said user's legs.

7. The rocker of claim 6 wherein said rocker is configured to release leg muscles of said user from muscle cramps.

8. The rocker of claim 3 further comprising:

a chassis assembly mechanically connected to said rocking assembly.

9. A rocker, comprising:

a rocking assembly comprising:

a first leg holder, wherein said first leg holder is configured to hold a leg of a user;

a second leg holder, wherein said second leg holder is configured to hold a leg of a user, wherein said second leg holder is mechanically connected to said first leg holder, a longitudinal rocking sub-assembly comprising:

a longitudinal rocking engine;

a shaft mechanically connected to said longitudinal rocking engine, for receiving a rotational movement;

a first first eccentric arm disposed on a first end of said shaft; and a second first eccentric arm disposed on a second end of said shaft, wherein said first first eccentric arm and said second first eccentric arm has a predetermined phase angle between both of them, and wherein said longitudinal rocking sub-assembly further comprises:

a first longitudinal rocking sub-assembly arm pivotally connected to said first first eccentric arm;

a first rider element pivotally connected to said first longitudinal rocking sub-assembly arm;

a first first axis pivotally connected to said first rider element;

a second longitudinal rocking sub-assembly arm pivotally connected to said second first eccentric arm;

a second rider element pivotally connected to said second longitudinal rocking sub-assembly arm; and a second first axis pivotally connected to said second rider element;

the rocker further comprising a lateral rocking sub-assembly wherein said lateral rocking sub-assembly comprising:

a lateral rocking engine;

a second eccentric arm mechanically connected to said lateral rocking engine, for receiving a rotational movement;

a lateral rocking sub-assembly first arm pivotally connected to said second eccentric arm;

a first lateral rocking sub-assembly third arm pivotally connected at an upper end of said first lateral rocking sub-assembly third arm to said lateral rocking sub-assembly first arm; and a lateral rocking sub-assembly second arm pivotally connected to said first lateral rocking sub-assembly third arm at a point that is located in a direction from a rotational center opposite to a direction from said rotational center to said upper end of said first lateral rocking subassembly third arm.

10. The rocker of claim 9 wherein said lateral rocking sub-assembly further comprising:

a second lateral rocking sub-assembly third arm pivotally connected to said lateral rocking sub-assembly second arm, at an upper end of said second lateral rocking sub-assembly third arm.

11. The rocker of claim 10 wherein said first leg holder is connected to a first second axis, wherein said first second axis is pivotally connected to said first lateral rocking sub-assembly third arm at a lower end of said first lateral rocking sub-assembly third arm, and wherein said second leg holder is connected to a second second axis, wherein said second second axis is pivotally connected to said second lateral rocking sub-assembly third arm at a lower end of said second lateral rocking sub-assembly third arm.

12. The rocker of claim 11 further comprising:

a chassis assembly mechanically connected to said rocking assembly.

13. The rocker of claim 12, wherein said chassis assembly comprising:

two chassis frames;

at least one chassis lateral pole mechanically connected to said two chassis frames; and a chassis housing mechanically connected to said two chassis frames, wherein said rocking assembly is mechanically connected to said chassis housing and wherein said rocking assembly is at least partially located inside said chassis housing.

14. The rocker of claim 11 wherein said first leg holder includes:

an aft clamp part;

a frontal clamp part pivotally connected to said aft clamp part;

at least one holder support member pivotally connected to said aft clamp part; and a piston pivotally connected to said aft clamp part.

15. The rocker of claim 11 further wherein said longitudinal rocking sub-assembly further includes:

a first frequency controller, electrically connected to said longitudinal rocking engine.

16. The rocker of claim 11 further wherein said lateral rocking sub-assembly further includes:

a second frequency controller, electrically connected to said lateral rocking engine.

17. The rocker of claim 9 configured to enable a user to connect said user's legs to said rocker while lying on said user's back and rocking said user's legs.

18. The rocker of claim 17 wherein said rocker is configured to release leg muscles of said user from muscle cramps.

* * * * *